US009706616B2

(12) United States Patent
Doorn et al.

(10) Patent No.: US 9,706,616 B2
(45) Date of Patent: Jul. 11, 2017

(54) METHOD FOR DYNAMIC REDUCTION OF LED CURRENT IN LED DRIVER, AND ASSOCIATED DRIVERS, DRIVER CIRCUITS AND LIGHTING CIRCUITS

(71) Applicant: Silergy Corp.

(72) Inventors: Tobias Sebastiaan Doorn, Eindhoven (NL); Arjan van den Berg, Nijmegen (NL)

(73) Assignee: Silergy Corp., Cayman Islands (GB)

( * ) Notice: Subject to any disclaimer, the term of this patent is extended or adjusted under 35 U.S.C. 154(b) by 0 days.

(21) Appl. No.: 14/995,347

(22) Filed: Jan. 14, 2016

(65) Prior Publication Data

US 2016/0242259 A1 Aug. 18, 2016

(30) Foreign Application Priority Data

Jan. 14, 2015 (CN) ..... 2015 1 0017703

(51) Int. Cl.
*H05B 33/08* (2006.01)

(52) U.S. Cl.
CPC ..... *H05B 33/083* (2013.01)

(58) Field of Classification Search
CPC combination set(s) only.
See application file for complete search history.

(56) References Cited

U.S. PATENT DOCUMENTS

| | | | |
|---|---|---|---|
| 8,552,656 | B2 | 10/2013 | Choi |
| 2011/0279047 | A1 | 11/2011 | Choi |
| 2012/0299497 | A1 | 11/2012 | Lee |
| 2013/0257282 | A1 | 10/2013 | van den Berg |
| 2014/0125235 | A1 | 5/2014 | van den Berg |

OTHER PUBLICATIONS

Park, Changbyung et al; "Filter-Free AC Direct LED driver with Unity Power Factor & Low I/P Current THD Using Binary Segment Switched LED Strings and Linear Current Regulator"; 28th Annual IEEE Applied Power Electronics Conference and Exposition; pp. 870-874 (2013).

*Primary Examiner* — Douglas W Owens
*Assistant Examiner* — Jianzi Chen

(57) ABSTRACT

There is disclosed a driver for driving a series arrangement being a variable number of strings of LEDs wherein each string has a capacitance connected in parallel with the respective string; the driver comprising: a controllable current source adapted to be connected in series between the series arrangement and a rectified AC supply to and source a controllable current (Istr) through the series arrangement; and a current source controller adapted to control the controllable current source; wherein the current source controller is operable to source a relatively lower current ($I_{LED}$') when a difference (Vstr3A) between the voltage across the series arrangement and the voltage of the rectified AC supply is relatively higher and a relatively higher current ($I_{LED}$) when the difference is relatively lower. Associated driver circuits and lighting circuits, and methods are also disclosed.

10 Claims, 6 Drawing Sheets

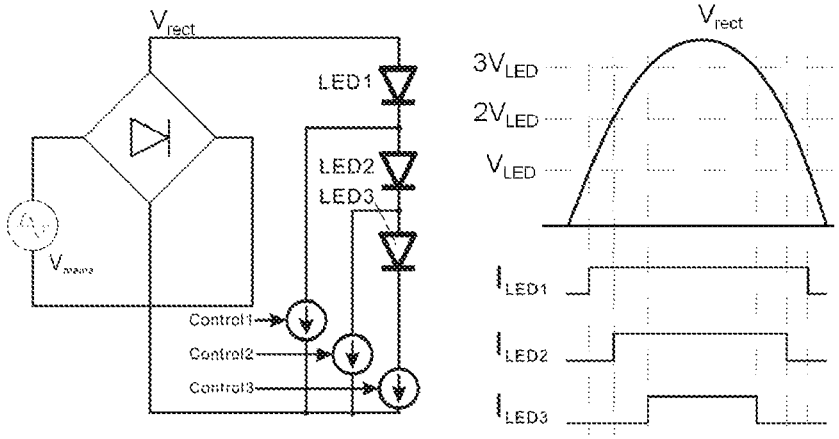
FIG 1 (conventional)
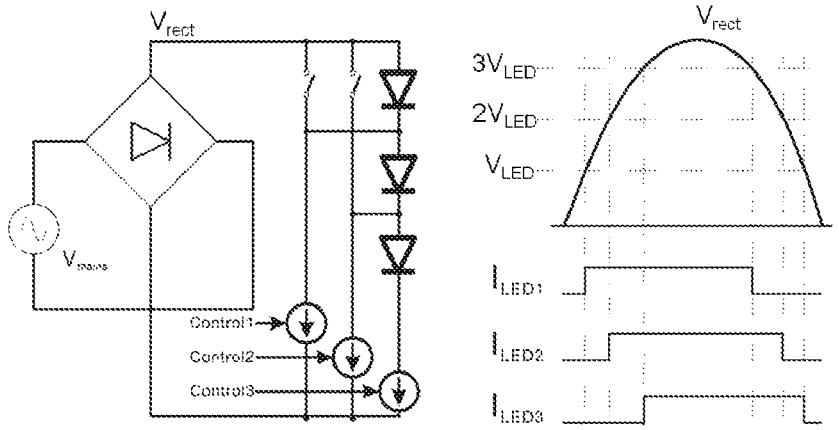
FIG 2 (conventional)

METHOD FOR DYNAMIC REDUCTION OF LED CURRENT IN LED DRIVER, AND ASSOCIATED DRIVERS, DRIVER CIRCUITS AND LIGHTING CIRCUITS

CROSS-REFERENCE TO RELATED APPLICATIONS

This application claims the priority under 35 U.S.C. §119 of Chinese patent application no. 201510017703.X, filed Jan. 14, 2015 the contents of which are incorporated by reference herein.

BACKGROUND

This invention relates to LED drivers, driver circuits LED circuits, and to method of operating LED drivers.

Nowadays, so-called direct-to-mains LED lighting circuits are becoming increasingly popular mainly because of form factor advantages and their low cost, although the latter depends on required performance. A linear LED driver is essentially a current source that drives high-voltage LEDs which are directly connected to the mains. Linear LED drivers are a new type of LED driver that directly connects one or multiple LEDs, or LED strings, to the mains.

FIG. 1 shows, schematically, a generic example of a "direct-to-mains" LED light circuit having a linear LED driver and the corresponding supplied voltage (Vrect) and LED string current ($I_{LED1}$, $I_{LED2}$ and $I_{LED3}$) curve graphs during operation. Depending on the mains voltage Vmains, a varying number of LED strings may be connected in series, as shown in FIG. 1. The mains voltage Vmains is rectified by rectifier 110. As the rectified mains voltage increases, the strings LED1, LED2 and LED3 are sequentially—and cumulatively—switched on, by being supplied with current from current sources by a controller enabling, in turn, control1, then control2 then control3 as shown. The controllable current sources and the controller are typically implemented in an integrated circuit (IC)—the driver chip. As the rectified mains voltage decreases past its peak the strings are one-by-one switched off.

Some direct-to-mains LED lighting circuits suffer from unequal LED on times as is evident from FIG. 1 (see $I_{LED1}$, $I_{LED2}$ and $I_{LED3}$), although this may be overcome by altering the switching sequence, from a "first-on-last-off" sequence to, for instance, a "first-on-first-off" sequence as disclosed in Applicant's co-pending patent application publication number US2013-0257282A1.

LED lighting circuits that are controlled with a linear LED driver suffer from 100% light ripple at twice mains frequency, as LED driving current cannot flow when the mains voltage is lower than $V_{LED}$. This could result in a poor quality of light, as 100% light ripple at twice the mains frequency can be uncomfortable to some people. In order to improve the quality of light, capacitors C1, C2, and C3 may be included in parallel with respective LED string LED1, LED2 and LED3, as shown in FIG. 2. During a start-up phase, the capacitors are charged to a value which is close to the string operating voltage. Then, during normal operation, the charge stored in the capacitors can be used to power the respective LED string, reduce the current ripple and increase the quality of light. To prevent the capacitors from being discharged, diodes D1, D2 and D3 are included in the series arrangement of LED strings, between the strings.

It will be appreciated that when a lamp is powered on, the capacitors need to be charged to VLED first before the LEDs emit any light. Therefore a startup phase is required in which the capacitors are charged as quickly as possible.

When the capacitors are still discharged, the full mains voltage is across the IC and the dissipation in the current source can be high even if a low to moderate charging current is used. For example, if the rectified mains voltage is Vrect, and the voltages across the capacitors are Vc1, Vc2 and Vc3, then the voltages (Vstr1A, Vstr2A and Vstr3A) at nodes Str1A, Str2A and Str3A would be, respectively, Vrect−Vc1, Vrect−Vc1−Vc2, and Vrect−Vc1−Vc2−Vc3. When the capacitors are discharged, Vc1, Vc2 and Vc3 are all (approximately) 0, so for a charging current LED, the power dissipated in the IC would be approximately Vrect.$I_{LED}$. Even for the relatively low US mains voltage of 120 Vrms the peak voltage is 170V. Depending on the physical size of the high-voltage transistors used in the driver small currents in the mA range can already lead to a significant temperature increase.

A further source of thermal power dissipation may occur during normal operation, due to the variability in the peak main voltage: the LED lamp should operate as expected at low (expected) peak mains voltage. During periods when the peak mains voltage is higher, the excess voltage is dropped in the IC containing the current source—once again this results in power dissipation which appears as heat.

SUMMARY

The invention provides methods and apparatus as defined in the independent claims.

According to one aspect of the present disclosure, there is provided a driver for driving a series arrangement being a variable number of strings of LEDs wherein each string has a capacitance connected in parallel with the respective string; the driver comprising: a controllable current source adapted to be connected in series between the series arrangement and a rectified AC supply to and source a controllable current (Istr) through the series arrangement; and a current source controller adapted to control the controllable current source; wherein the current source controller is operable to source a relatively lower current ($I_{LED}$') when a difference (Vstr3A) between the voltage across the series arrangement and the voltage of the rectified AC supply is relatively higher and a relatively higher current ($I_{LED}$) when the difference is relatively lower.

By providing a relatively lower current when the difference is relatively higher, it may be possible to reduce the power dissipation in the driver, which may reduce the heating of the driver circuit. This may, for example, simplify the thermal management of the lighting circuit. Alternatively or in addition, it may be possible to use transistors which have a lower power rating (i.e. a smaller area), thereby providing a potential cost saving.

In one or more embodiments, the current source controller is configured to adjust the current in dependence on the charging level of the capacitors, and the relatively lower current is a first relatively lower current. In one or more embodiments the current source controller is configured to source the first relatively lower current in response to the difference (Vstr3A) being greater than a reference level Vref. Since most—or in the idealized case of there being no other series components and loss-less connections, all—of the difference $V_{str3A}$ is dropped in the driver IC, by reducing the charging current to a relatively lower level once the difference exceeds a reference level, the power dissipation in the IC can thereby be reduced.

Dynamically adjusting the charging current depending on the momentary mains voltage might thus tend to simultaneously ensure acceptable average driving current (for example to provide for acceptable charging times during startup) and acceptable IC dissipation and resulting temperature increase.

In one or more embodiments the driver is adapted for operation with a series combination of a resistor having resistance $R_{OV}$ and a Zener diode having a voltage drop Vov, the series combination being connected in parallel with the current source; wherein the current source controller comprises a current comparator configured to compare the current through the resistor with a reference current Istartup, and the reference current has a fixed relationship with the reference level according to the relationship: $Vref=V_{OV}+Istartup.R_{OV}$. The (voltage) difference may thereby by converted into an associated current, and use of a reference current Istartup and a current comparator may allow for convenient processing and therefore simple and/or space-efficient circuit design in the driver IC. Furthermore, by carrying out the signal processing in the current domain, this aspect may be made to be compatible with other aspects—in particular, accommodating varying peak mains voltage, as will be described in more detail hereinbelow; alternatively and without limitation, the comparison may be done in the voltage domain by converting the current through resistor $R_{OV}$ into a voltage and compare it to an internal voltage reference.

In one or more embodiments the first relatively lower current is half the relatively higher current. This may result in at least halving the power dissipation during high-voltage parts of the mains cycle.

In one or more embodiments the current source controller is operable to source a second relatively lower current ($I_{LED}$") when the difference (Vstr3A) between the voltage across the series arrangement and the voltage of the rectified AC supply is relatively higher and a relatively higher current ($I_{LED}$) when the difference is relatively lower, during normal operation when all the LEDs are emitting light. Such embodiments may be operable to reduce the power dissipated in the IC, during periods when the RMS (and peak-) mains voltage is high. Furthermore, by reducing or even eliminating the dependence of the power dissipation on mains voltage variation, it may be possible to use a smaller heat sink (since the thermal losses will be reduced): without the relatively low-current operation at high voltage, the thermal design of the lamp would have to be dimensioned for the worst-case dissipation corresponding to full current and high mains voltage (ie relatively higher than typical mains voltage) operation, even at exceptionally high voltages (at which times the voltage in the IC is high). This would result in an over-dimensioned heat sink for the typical operating condition, which also implies a sub-optimal cost.

In one or more embodiments the second relatively lower current has a fixed relationship with the relatively higher current. By providing a step-change in the current, the circuit may be designed to be similar to that used to provide a step-change to the first relatively lower current used during start-up. In one or more other embodiments the second relatively lower current varies in dependence on the mains voltage such that the product of the difference (Vstr3A) and the second relatively lower current is constant. It may thereby be possible to significantly reduce, or even eliminate, the variation of power dissipation within the IC with variation in peak mains voltage. It may thereby be possible to simplify the thermal design of the IC, and/or it may be possible to avoid over-specifying the power switches required in the driver.

In one or more embodiments the driver is adapted for operation with a series combination of a resistor having resistance $R_{OV}$ and a Zener diode having a voltage drop $V_{OV}$, the series combination being connected in parallel with the current source; wherein the current source controller comprises a current summing unit configured to subtract a current $I_{OV}$ through the resistor from a LED reference current $I_{ref,LED}$ and a scaling unit configured to scale the resultant current, and is configured to reduce the relatively higher current by the scaled resultant current to result in the second relatively lower current. By implementing the current source controller in this way, the design may be similar to that which may be used to provide the first relatively lower current during start-up, thereby providing a potential for re-use, or sharing, of components or design, or overall design simplification.

According to another aspect of the present disclosure, there is provided a driver circuit comprising a driver as described above, and a series combination of a resistor having resistance ROV and a zener diode having a voltage drop VOV, the series combination being connected in parallel with the current source.

According to yet another aspect of the present disclosure, there is provided a lighting device comprising such a driver circuit, a series arrangement of a plurality of strings of LEDs and a plurality of capacitors arranged such that each string has a capacitor connected in parallel with the respective string.

According to further aspect of the present disclosure, there is provided method of controlling the current in LED lighting circuit comprising a series arrangement, the series arrangement comprising a variable number of strings of LEDs in series wherein each string has a capacitance connected in parallel with the respective string; and a driver comprising: a controllable current source connected in series between the series arrangement and a rectified AC supply to and source a controllable current (Istr) through the series arrangement, and a current source controller adapted to control the controllable current source; the method comprising operating the current source controller to source a relatively lower current (Istr') when a difference (Vstr3A) between the voltage across the series arrangement and the voltage of the rectified AC supply is relatively higher and a relatively higher current (Istr) when the difference is relatively lower.

In one or more embodiments the method comprises dynamically reducing a startup current through the series arrangement by adjusting the current in dependence on the charging level of the capacitors.

In one or more embodiments the method comprises operating the current source controller to source a second relatively lower current ($I_{LED}$") when the difference (Vstr3A) between the voltage across the series arrangement and the voltage of the rectified AC supply is relatively higher and a relatively higher current ($I_{LED}$) when the difference is relatively lower, during operation when all the LEDs are emitting light. The method may comprise varying the second relatively lower current in dependence on the mains voltage such that the product of the difference (Vstr3A) and the second relatively lower current is constant.

BRIEF DESCRIPTION OF THE DRAWINGS

FIG. 1 shows a generic example of a "direct-to-mains" LED light circuit having a linear LED driver and the voltage and current graph accordingly;

FIG. 2 shows a simplified schematic of an LED lighting circuit including parallel capacitors;

FIG. 8(*b*) shows the graph illustrating losses in the driver during normal operation with relatively high peak mains voltage;

DETAILED DESCRIPTION

Figure 3:
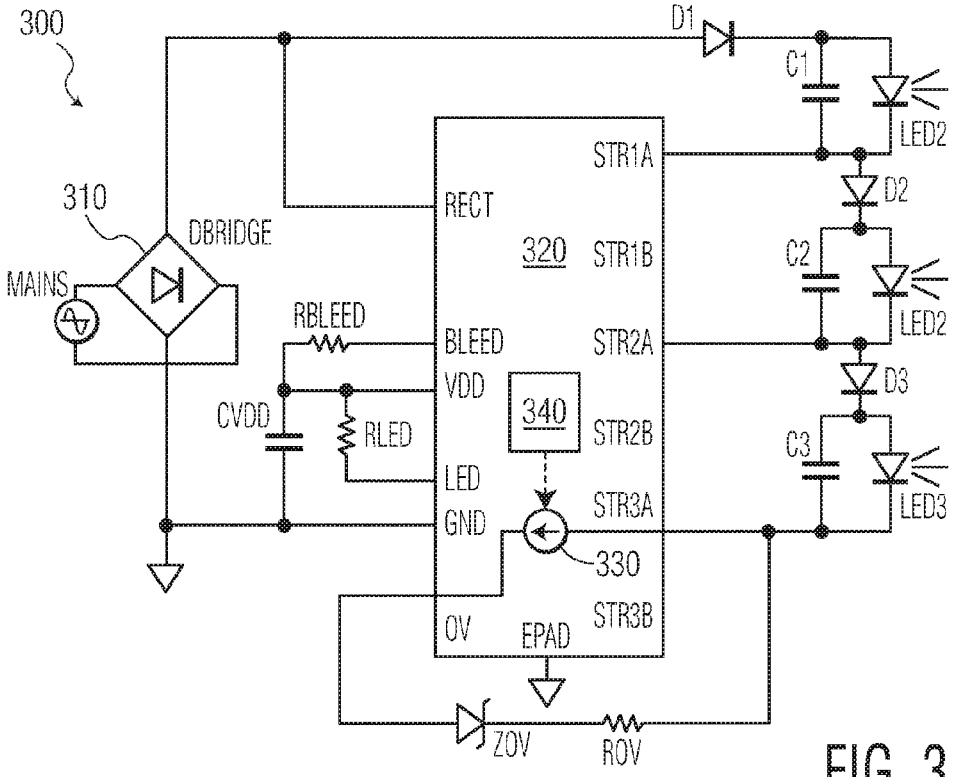
FIG. 3 shows an LED lighting circuit according to one or more embodiments.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments.

FIG. 3 shows an LED lighting circuit 300 according to one or more embodiments. The circuit is powered from an AC Mains, which is rectified in a rectifier 310. The rectified mains voltage Vrect is supplied to the first LED string, LED1, of a plurality of LED strings LED1, LED2 and LED3, by a blocking diode D1. A further blocking diode. D2, D3 connects each of the other LED strings in a series arrangement with LED string LED1. Respective capacitors C1, C2, C3 are connected in parallel with each LED (respectively). The capacitors C1, C2, C3 may be used to store charge, which is used to power the respective LED string while Vrect<$V_{LED}$, thereby reducing the current ripple and increasing the quality of light, which may be more comfortable to people. Blocking Diodes D1, D2, D3 prevent capacitors C1, C2, C3 from discharging.

The LED circuit comprises a driver 320, which controls the operation of the LED strings, as well be explained in more detail herein below. The driver may be implemented as an integrated circuit (IC). The driver 320 is powered from the rectified mains. A capacitor CVDD is provided as an auxiliary power supply to the driver, to ensure to ensure continued operation even when the rectified mains voltage is not sufficient to power the driver. As shown, there may also be an LED resistor $R_{LED}$ and a bleed resistor $R_{BLEED}$ to set the LED driving current and bleeder current respectively. A bleeder circuit may be added to the driver to increase dimmer compatibility. Each string is connected to the driver at its respective distal end from Vrect, shown at STR1A, STR2A and STR3A. The driver includes a switching arrangement (not shown), which ensures that as the mains voltage is increased, the LED strings are successively switched on, by connecting them to the current source 330. The controller is shown in the state with the current source 330 supplying all the strings by being connected to STR3A. The skilled person will appreciate that driver 320 is thus depicted in simplified form, with respect to the switching arrangement. More completed switching arrangements may be used, such as will be mentioned briefly with respect to FIG. 4 herein below. The current source 330 is controllable, by means of current source controller 340.

Connected between the bottom-most LED string LED3 ground, is a series combination of a current sensor resistor $R_{OV}$ and a zener diode $Z_{OV}$. The Zener diode provides an offset voltage $V_{OV}$, and the resistor $R_{OV}$ converts the difference voltage Vstr3A-$V_{OV}$ into a current.

Figure 4:
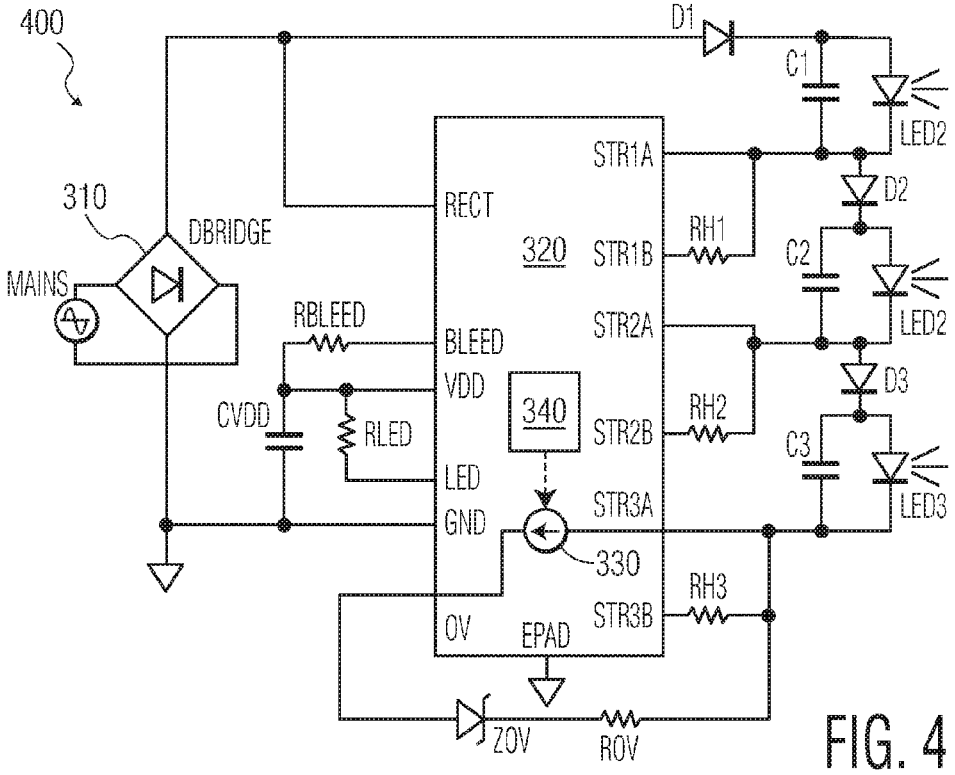
FIG. 4 shows an LED lighting circuit according to one or more embodiments.

FIG. 4 shows an LED lighting circuit according one or more embodiments. This circuit is similar to that shown in FIG. 3, except that an additional current path between the lower voltage end (that is, the bottom-most) of each of the LED strings, and the driver, is shown. These additional current paths each include a respective heat-sink resistor, RH1, RH2 and RH3 respectively. In normal operation, the heatsink resistors RH1, RH2 and RH3 are used to reduce the thermal dissipation within driver 320, as will now briefly be explained: recall that LEDs have a highly non-linear current-voltage characteristic such that in operation, the voltage across an LED string may be considered to be nearly constant ($V_{LED}$). As the rectified mains voltage Vrect increases beyond the voltage at which first LED string LED1 is switched on but before it reaches the voltage at which the second LED string LED2 can also be switched on, the excess voltage (Vrect−$V_{LED}$), has to be dropped somewhere. This results in a power dissipation of I.(Vrect−$V_{LED}$). Absent the additional current paths, the voltage is dropped inside driver 320, resulting in the entire power dissipation occurring inside the driver IC. However, by appropriate control of the current driver current, and in particular by correctly splitting it between the path STR1B including the heatsink resistor and the path STR1A excluding the heatsink resistor, at least the part of this power dissipation can be made to occur in the heatsink resistor RH1. Since this resistor is external to driver 320, the thermal management of the system, and in particular the temperature control of the driver IC 320, may thereby be simplified. In other respects the arrangement shown in FIG. 4 is similar to that shown in FIG. 3.

The driver IC includes current source functionality. This will now be described, and control thereof in embodiments during startup operation, with reference to FIG. 5. At start-up, when the capacitors are completely discharged, $V_{C1}$=0V, $V_{C2}$=0V and $V_{C3}$=0V and so the voltage across the current source is $V_{Rect}$. When a lamp is powered on, the user expects it to turn on instantaneously, or nearly instantaneously. But when the capacitors C1, C2, C3 are used in parallel with the LEDs, the capacitors need to be charged to VLED first before the LEDs emit any light. Therefore a startup phase may be required in which the capacitors are charged quickly. However, when the capacitors C1, C2, C3 are still discharged, the full mains voltage which is across the IC and the dissipation in the current source may be high even if a low to moderate charging current is used. Depending on the physical size of the high-voltage transistors used in the current source, small currents in the mA range can already lead to a significant temperature increase. To guarantee the lifetime of the IC, this temperature increase may need to be controlled to acceptable levels.

Figure 5:
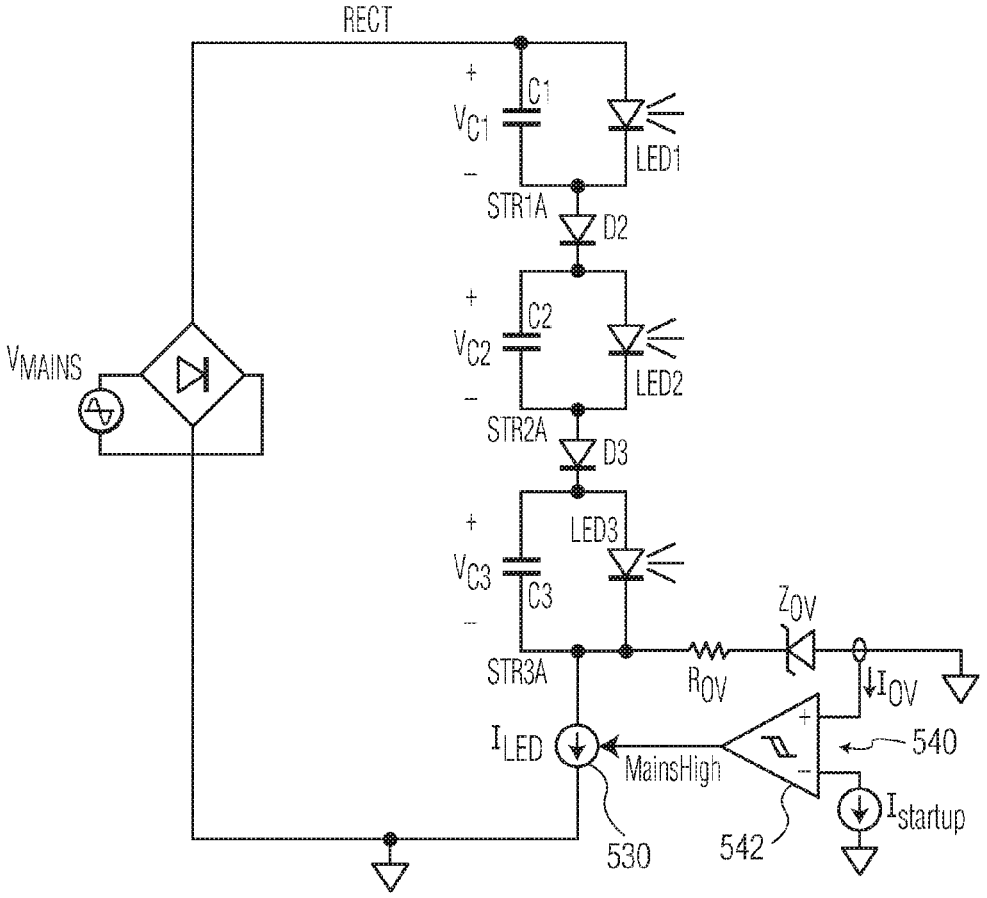
FIG. 5 shows a schematic circuit according to operation of one of more embodiments.

As shown in FIG. 5, the driver includes a current source providing a current LED According to one or more embodiments, there is a current source controller 540, which is configured to adjust the charging current of LED driver circuit, at current source 530, depending on the charging level of the capacitors. In one or more embodiments as shown, the current source controller may comprise a comparator 542. During startup phase, the charging current $I_{str}$ may be dynamically set by the comparator, and in particular, if the comparator shows that $I_{OV}$ is higher than a reference current Istartup, the current source is set to source a relatively lower current $I_{LED}'$, than when $I_{OV}$ is not higher than the reference current Istartup. There is thus provided a method to dynamically adjust the charging current Istr to either $I_{LED}$ or $I_{LED}'$ depending on the charging level of the capacitors.

To explain this in more detail, note that the charging level of the capacitors can be measured at node Str3A. The voltage $V_{str3A}$ can be described by the equation (1) below.

$$V_{str3A}=V_{Rect}-V_{C1}-V_{C2}-V_{C3} \quad (1)$$

The linear driver circuit may comprise a resistance $R_{OV}$. $V_{str3A}$ can be converted into a current using $R_{OV}$. An offset voltage $V_{OV}$ can be subtracted from $V_{str3A}$ by arranging a Zener diode $Z_{OV}$ which drops a voltage $V_{OV}$ in series with the resistance $R_{OV}$. The resulting current $I_{OV}$ can be described by the equation (2) as below.

$$I_{OV} = \frac{V_{Str3A} - V_{OV}}{R_{OV}} \quad (2)$$

The comparator may be used to compare $I_{OV}$ with startup current $I_{startup}$. If $I_{OV}>I_{startup}$, the output of the mains high comparator is high and the charging current Istr is reduced from $I_{LED}$ to a relatively lower value $I_{LED}'$, to reduce the dissipation and temperature increase in the IC.

This corresponds to the condition:

$$\text{a. } I_{OV}>I_{startup}; \quad (3)$$

that is to say:

$$\frac{V_{Str3A} - V_{OV}}{R_{OV}} - \frac{Vstartup}{R_{OV}} > 0; \quad (4)$$

by defining Vstartup=Istartup.$R_{OV}$;

or $V_{str3A}$>Vref, by defining Vref=$V_{OV}$+Vstartup.

Using this approach, two values for the charging current can be set. The concept however can be easily extended to include more $I_{startup}$ levels or even use $I_{OV}$ to linearly decrease Istr with increasing $I_{OV}$.

Figure 6:
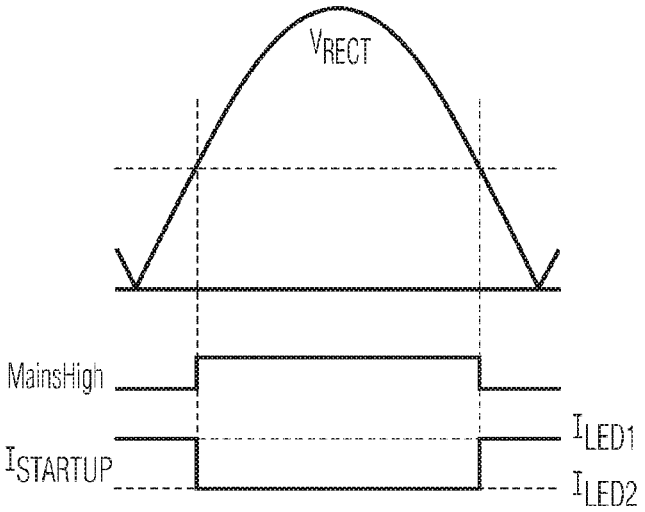
FIG. 6 shows the voltage on the current source and LED current curve graph during startup phase according to one or more embodiments, such as those illustrated in FIG. 5.

FIG. 6 shows the voltage on the current source $V_{Rect}$, the output "Mainshigh" from the current source controller, and the LED current curve graph during startup phase, over a half-cycle of the rectified mains. When the $V_{Rect}$ is low, a high LED current $I_{LED}$ can be used. When a high mains voltage is detected, a lower LED current $I_{LED}'$ is used to limit the dissipation in the current source.

Figure 7:
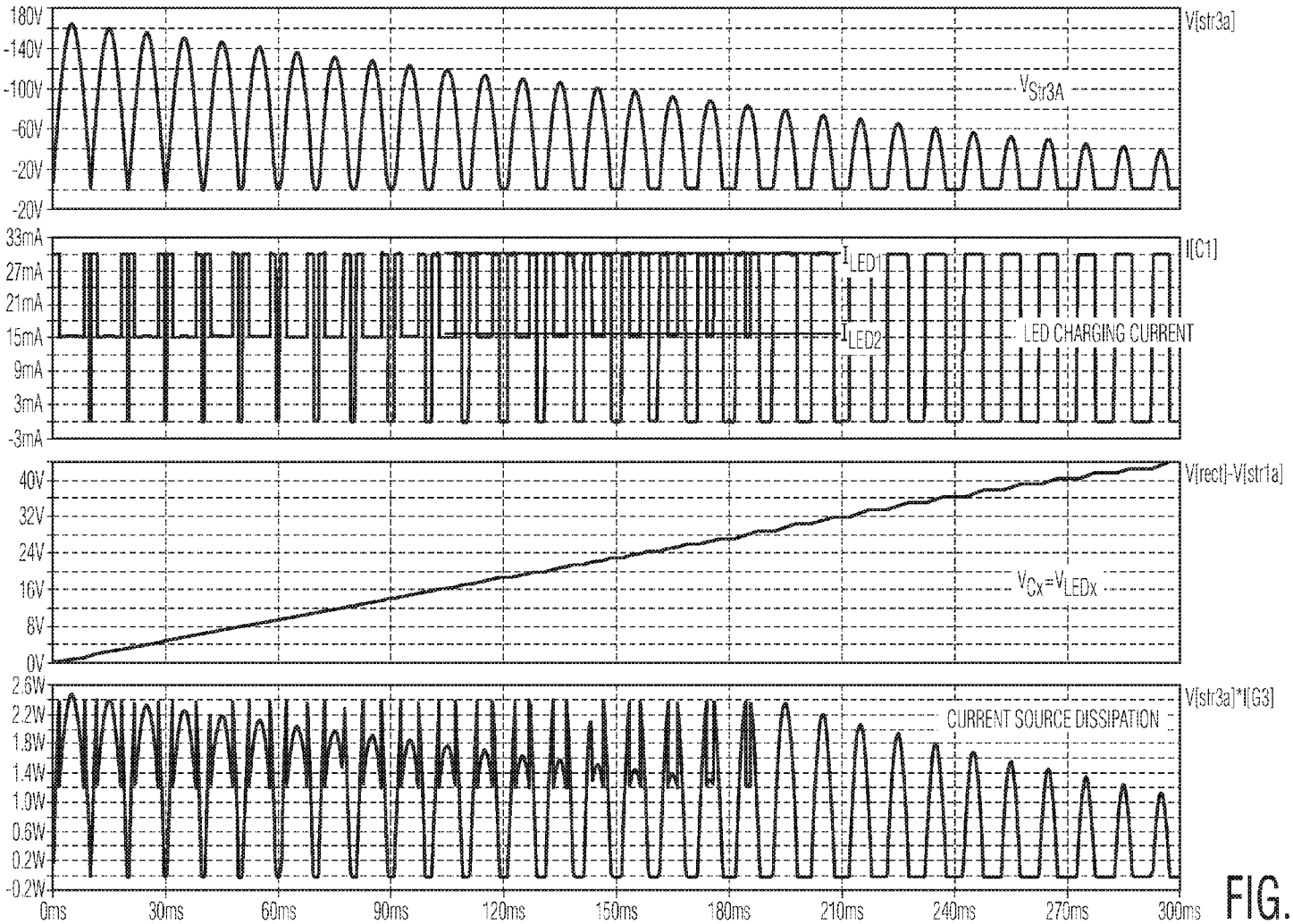
FIG. 7 shows the waveforms during startup phase using dynamic charging current according to one or more embodiments, such as those illustrated in FIG. 5.

FIG. 7 shows the waveforms $V_{str3A}$ at 710, the source current $I_{LED}$ at 720, the voltages across one of the LED strings and corresponding capacitor (ie $V_{Cx}$=Vrect−VStr1A) at 730 and the power dissipated in the driver IC (VStrA*$I_{LED}$) at 740, during startup phase using dynamic charging current. When the capacitor voltage $V_{Cx}=V_{LEDx}$ is still low, the current source voltage is high and its dissipation would be high. Therefore the current is low for a relatively larger portion of the mains cycle, shown at 722, to reduce this effect. As the capacitors are charged further, the current source voltage $V_{Str3A}$ becomes lower and lower and the portion with low current becomes shorter and shorter, as shown at 724 and 726. In this example, the charging current changes between 15 mA for high mains and 30 mA for low mains, which limits the current source dissipation to about 2.4 W. Without the dynamic reduction in current, the peak current source dissipation would have been nearly twice as high, which may have serious consequences for the size of the transistors in the current source required to meet lifetime specifications.

Figure 8A:
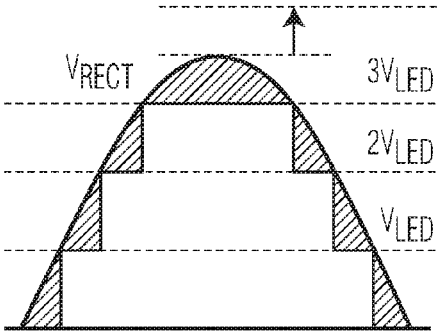
FIG. 8(*a*) shows the graph illustrating losses in the driver during normal operation with relatively low peak mains voltage.
Figure 8B:
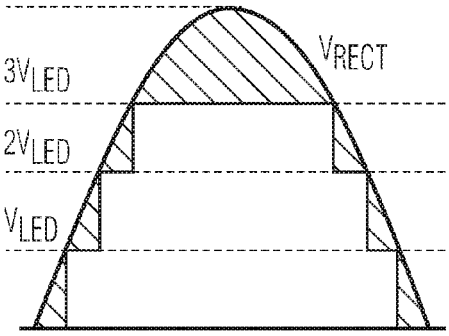

FIG. 8(*a*) shows losses of the linear driver during normal operation with relatively low peak mains voltage, and FIG. 8(*b*) shows losses of the linear driver during normal operation with relatively high peak mains voltage. As shown, the mismatch between the total LED voltage and the mains voltage mainly determines the losses of the linear driver in normal operation. The losses at typical mains, with relatively low peak voltages, are indicated at 810, 812, 814, and 816 in FIG. 8(*a*). At high mains situations, the losses increase further, as shown at 820, 822, 824 and 826 in FIG. 8(*b*). For their efficiency and therefore their dissipation, linear drivers depend on how well the LED voltage "fits" in the mains voltage. This is illustrated in FIGS. 8(*a*) and 8(*b*), which show an overall significantly better fit for normal or nominal mains voltage, than for relatively high mains voltages. A constant current is drawn from the mains throughout the complete mains cycle, and the number of LEDs in series is increased as the mains voltage increases and decreased again as the mains voltage decreases. When $V_{LED}<V_{Rect}<2V_{LED}$, $(V_{Rect}-V_{LED})*I_{LED}$ represents the bulk of the losses. As can be seen, for the relatively high mains voltage, the losses are dominated around the peak of the mains voltage (at which times the "head-room" due to the excess voltage between $V_{Rect}-3V_{LED}$ is dropped in the driver IC). One or more embodiments may allow reduction in these losses, by adapting $I_{LED}$ over this part of the mains cycle, in conditions of high peak mains voltage.

Figure 9:
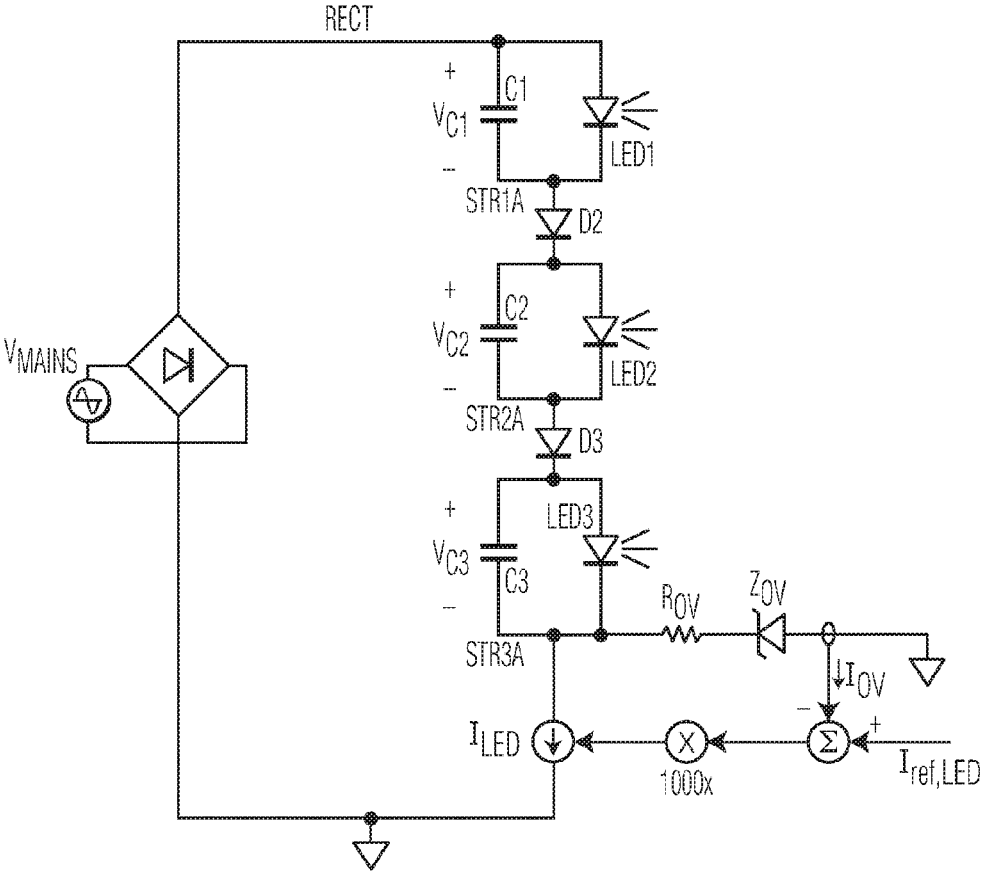
FIG. 9 shows a schematic circuit according to operation of one or more embodiments.

FIG. 9 shows a schematic circuit according to operation of one or more of such embodiments. There is a current source controller configured to dynamically reduce the driving current of LED driver circuit as the mains voltage increases. As shown, the circuit may comprise a resistance $R_{OV}$ and a Zener diode $Z_{OV}$, connected in series between the node Str3A and ground or 0V as shown. $R_{OV}$ and $Z_{OV}$ are arranged to convert $V_{str3A}$ into an associated current $I_{OV}$. The current source controller shown comprises a summing point 942 that subtracts $I_{OV}$ from an LED reference current $I_{ref,LED}$. The current source controller shown further comprises a scaler 944, which scales the difference $I_{OV}-I_{ref,LED}$. The scaling factor may be, as shown, 1000, and in general will depend on the choice of value for the resistor $R_{OV}$ and $I_{refLED}$. The scaled difference is used to adapt the current $I_{LED}$ to a second relatively lower current $I_{LED}''$. As shown in this example, the second relatively lower current $I_{LED}''$ may thus not be fixed, but may vary as the voltage Str3A increases. Since the current in the driver decreases as the voltage across it increases, it may thereby be possible to reduce the variation in power dissipation, with variation in mains peak voltage, or even to achieve a constant power.

Without any counter measures, the thermal design of the lamp would have to be dimensioned for the worst-case dissipation. This results in an over-dimensioned heat sink for the typical operating condition, which implies a sub-optimal cost structure. It may be beneficial to have a power dissipation that is independent of mains voltage variation because a smaller heat sink is required.

In other embodiments (not shown), which may be described as "step" embodiments, the voltage VStr3A is compared with a reference voltage, and the current driver current reduced, step-wise, if the voltage VStr3A exceeds the threshold. Such embodiments having a single step corresponding to a single reference voltage may be similar to embodiments described earlier to reduce power dissipation during start-up. The skilled person would appreciate that the concept may readily be extended to several reference voltages, corresponding to several steps. In the limit, with many reference voltages and many steps, such embodiments would, in operation, be similar to the continuous variation of the second relatively low current described above with reference to FIG. 9.

Figure 10:
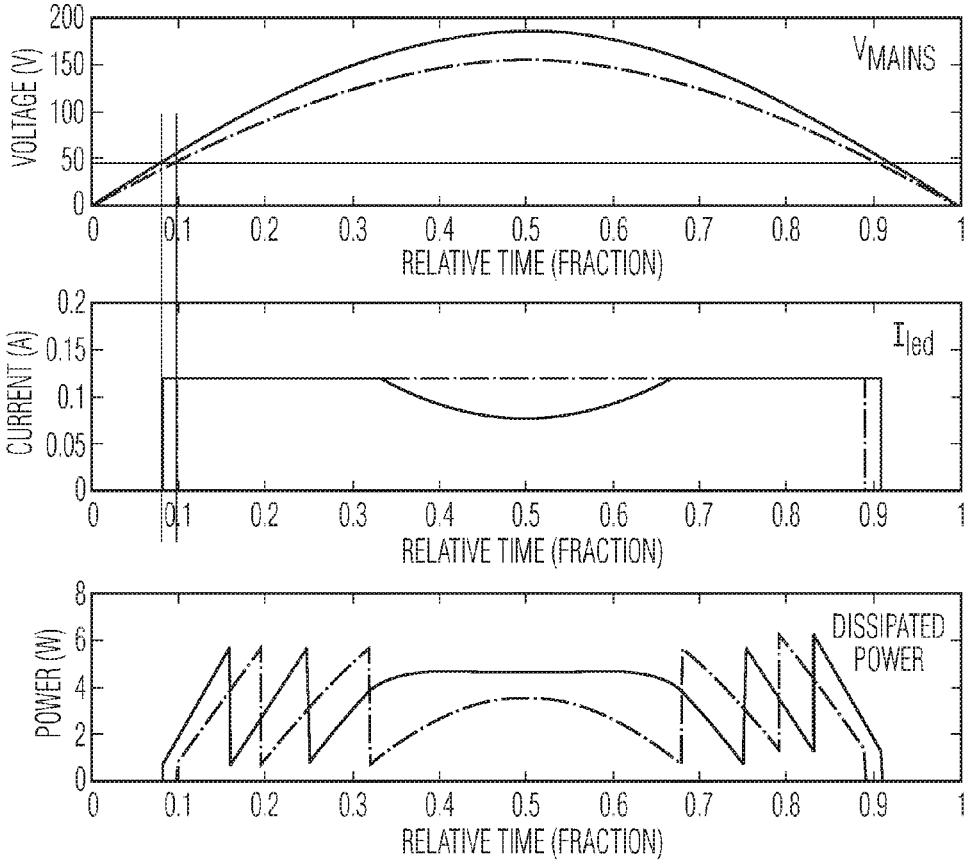
FIG. 10 shows a graph of Vmains, ILEA and dissipated power.

FIG. 10 shows plots of $V_{mains}$ (at 1010 and 1015), $I_{str}$ (at 1020, 1025 and 1025') and dissipated power (at 1030 1035, and 1035'), across a half-cycle of the rectified mains for normal peak mains voltage (at 1010, 1020 and 1030), and for high peak mains voltages (at 1015, 1025, and 1035 for embodiments such as that illustrated in FIG. 9, and at 1015, 1025' and 1035' for a single "step" embodiment as discussed above). For the continuous variation embodiments, the feedback at high mains voltage reduces the LED current, keeping the dissipation in the current source approximately constant (shown at 1035) around the peak voltage of the mains. For single step embodiments, in which the current is reduced to a constant second relatively lower current around the peak of the mains cycle, the power dissipation is not constant, but varies as shown as 1035'. Nonetheless, the power dissipation is still significantly reduced relatively to what it would be with no current reduction.

As shown at 1025 and 1035, for the embodiment shown in FIG. 9, $R_{OV}$ and $Z_{OV}$ convert $V_{str3A}$ into a current that is linearly proportional to $V_{Rect}$. By subtracting this current from the LED reference current $I_{ref,LED}$, a nearly constant power dissipation is achieved. This may allow both the current source in the IC and the complete application to be dimensioned for the typical power level instead of the worst case power level, which may thus save cost.

Figure 11:
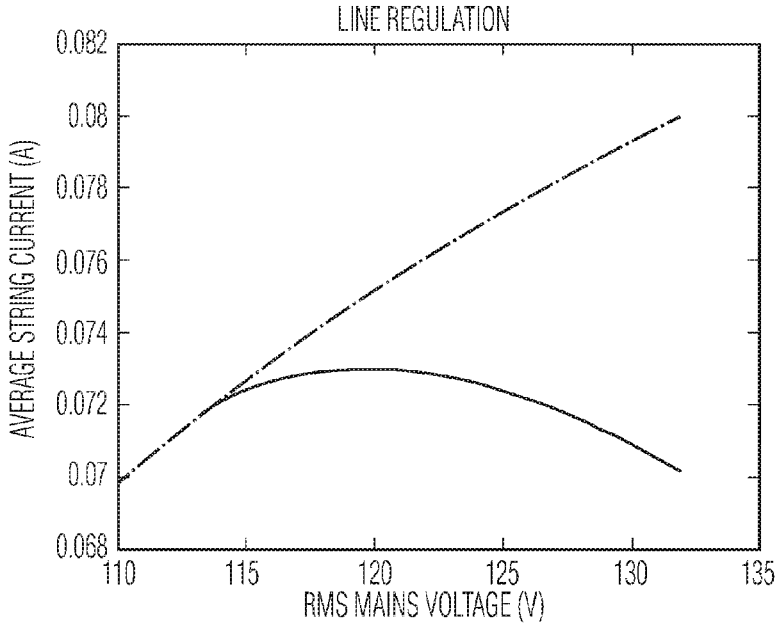
FIG. 11 shows linear driver line regulation.

FIG. 11 shows the average string current without (at 1110) and with (at 1120) dynamic LED current reduction according to one or more embodiments. It shows the average string current as a function of line regulation—that is to say, the peak mains voltage. It clearly shows that with dynamic LED current reduction, the average LED current is much more constant than without the reduction, therefore the line regulation is improved. Normally, when the mains voltage increases, the on-time of the LEDs is increased, which increases the average current (1110) and therefore the light output. This is an undesired effect, as customers expect a constant light output regardless of the mains voltage. By reducing the LED driving current at the peak of the mains voltage, the average current is reduced (as shown at 1120) and line regulation is improved.

The skilled person will appreciate that an LED string may consists of a single LED, or may include several LEDs connected in series, to achieve a suitable operating voltage.

Features which are described in the context of separate embodiments may also be provided in combination in a single embodiment. Conversely, various features which are, for brevity, described in the context of a single embodiment, may also be provided separately or in any suitable subcombination. The applicant hereby gives notice that new claims may be formulated to such features and/or combinations of such features during the prosecution of the present application or of any further application derived therefrom.

From reading the present disclosure, other variations and modifications will be apparent to the skilled person. Such variations and modifications may involve equivalent and other features which are already known in the art of LED drivers, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A driver for driving a series arrangement being a variable number of strings of LEDs wherein each string has a capacitor connected in parallel with the respective string, the driver comprising:

a controllable current source adapted to be connected in series between the series arrangement and a rectified AC supply, and to source a controllable current through the series arrangement;

a current source controller adapted to control the controllable current source, wherein the current source controller is operable to source a relatively lower current when a difference between the voltage across the series arrangement and the voltage of the rectified AC supply is relatively higher and a relatively higher current when the difference is relatively lower, and wherein the relatively lower current is a first relatively lower current;

the current source controller being configured to adjust the current in dependence on the charging level of the capacitors, and to source the first relatively lower current in response to the difference being greater than a reference level; and the driver being adapted for operation with a series combination of a resistor and a zener diode having a voltage drop, the series combination being connected in parallel with the current source, wherein the current source controller comprises a current comparator configured to compare the current through the resistor against a reference current, and the reference current has a fixed relationship with the reference level.

2. The driver of claim 1, wherein the first relatively lower current is half the relatively higher current.

3. The driver of claim 1, wherein the current source controller is operable to source a second relatively lower current when the difference between the voltage across the series arrangement and the voltage of the rectified AC supply is relatively higher and a relatively higher current when the difference is relatively lower, during operation when all the LEDs are emitting light.

4. The driver of claim 3, wherein the second relatively lower current has a fixed relationship with the relatively higher current.

5. The driver of claim 3, wherein the second relatively lower current varies in dependence on the mains voltage such that the product of the difference and the second relatively lower current is constant.

6. The driver of claim 5, wherein the current source controller comprises a current summing unit configured to subtract a current through the resistor from an LED reference current and a scaling unit configured to scale the resultant current, and is configured to reduce the relatively higher current by the scaled resultant current to result in the second relatively lower current.

7. A method of controlling a current in an LED lighting circuit comprising a series arrangement, being a variable number of strings of LEDs wherein each string has a capacitance connected in parallel with the respective string, and a driver comprising: a controllable current source connected in series between the series arrangement and a rectified AC supply to and source a controllable current through the series arrangement, and a current source controller adapted to control the controllable current source, the method comprising:

operating the current source controller to source a relatively lower current when a difference between the voltage across the series arrangement and the voltage of the rectified AC supply is relatively higher and a relatively higher current when the difference is relatively lower, wherein the relatively lower current is a first relatively lower current;

adjusting, by the current source controller, the current in dependence on the charging level of the capacitors, and sourcing the first relatively lower current in response to the difference being greater than a reference level; and operating the driver with a series combination of a resistor and a zener diode having a voltage drop, the series combination being connected in parallel with the current source, wherein the current source controller comprises a current comparator for comparing the current through the resistor against a reference current, and the reference current has a fixed relationship with the reference level.

8. The method of claim 7, further comprising dynamically reducing a startup current through the series arrangement by adjusting the current in dependence on the charging level of the capacitors.

9. The method of claim 7, further comprising operating the current source controller to source a second relatively lower current when the difference between the voltage across the series arrangement and the voltage of the rectified AC supply is relatively higher and a relatively higher current when the difference is relatively lower, during operation when all the LEDs are emitting light.

10. The method of claim 9, further comprising varying the second relatively lower current in dependence on the mains voltage such that the product of the difference and the second relatively lower current is constant.

* * * * *